US006408712B1

(12) United States Patent
Bolisetty et al.

(10) Patent No.: US 6,408,712 B1
(45) Date of Patent: Jun. 25, 2002

(54) PEDAL ASSEMBLY WITH NON-CONTACT PEDAL POSITION SENSOR FOR GENERATING A CONTROL SIGNAL

(75) Inventors: Venkata Ramana Bolisetty, Sterling Heights; James S. Baughman, Deford, both of MI (US)

(73) Assignee: Teleflex Incorporated,, Plymouth Meeting, PA (US)

( * ) Notice: Subject to any disclaimer, the term of this patent is extended or adjusted under 35 U.S.C. 154(b) by 0 days.

(21) Appl. No.: 09/603,136

(22) Filed: Jun. 23, 2000

Related U.S. Application Data

(60) Provisional application No. 60/159,663, filed on Oct. 15, 1999, and provisional application No. 60/192,210, filed on Mar. 27, 2000.

(51) Int. Cl.[7] ..... G05G 1/14
(52) U.S. Cl. ..... 74/514; 74/560
(58) Field of Search ..... 74/512, 513, 514, 74/560; 338/32 H, 32 R, 12; 324/207.25

(56) References Cited

U.S. PATENT DOCUMENTS 4,179,949 A 12/1979 Hildebrecht
4,364,022 A * 12/1982 Melocik et al. ..... 338/32 H
4,443,716 A 4/1984 Avery
4,455,516 A * 6/1984 Furusho ..... 324/207.25 X
4,543,569 A 9/1985 Karlstrom
4,570,118 A * 2/1986 Tomczak et al. .... 324/207.22 X
4,883,037 A * 11/1989 Mabee et al. ..... 74/513 X
4,965,417 A 10/1990 Massie
4,983,915 A * 1/1991 Rossi ..... 324/207.25 X
5,013,930 A 5/1991 Spakowski et al. ..... 307/10.1
5,115,186 A * 5/1992 Reinartz et al. ..... 74/513 X
5,439,275 A 8/1995 Padula et al.
5,448,029 A 9/1995 Leorat et al.
6,089,120 A * 7/2000 Lochle et al. ..... 74/514

* cited by examiner

*Primary Examiner*—Thomas R. Hannon
*Assistant Examiner*—Timothy McAnulty
(74) *Attorney, Agent, or Firm*—Howard & Howard

(57) ABSTRACT

A pedal assembly is mounted on a body structure of a motor vehicle and is used to generate a control signal for vehicle system. The pedal assembly includes a support mounted to the body structure and a pedal arm with an upper end pivotally mounted to the support for movement relative to the body structure and a lower end for supporting a pedal pad. The pedal arm is movable between a plurality of operational positions as a force is applied to the pedal pad. A magnet is mounted to the pedal arm for pivotal movement with the pedal arm between the various operational positions. The magnet is preferably permanent magnet having a cylindrical shape and including multiple poles alternating between positive and negative orientations about the circumference of the magnet. A noncontact sensor is mounted adjacent to the magnet such that the sensor remains fixed relative to the pedal at all operational positions. The sensor generates an electric control signal that is used to control a vehicle system as the pedal arm is moved between the operational positions. The signal varies in magnitude by the extent of angular rotation of the magnet relative to the sensor.

3 Claims, 2 Drawing Sheets

PEDAL ASSEMBLY WITH NON-CONTACT PEDAL POSITION SENSOR FOR GENERATING A CONTROL SIGNAL

RELATED APPLICATIONS

This application claims priority to provisional applications 60/159,663 filed on Oct. 15, 1999 and 60/192,210 filed on Mar. 27, 2000.

TECHNICAL FIELD

The subject invention relates to a pedal assembly with a sensor that generates an electric signal for controlling a vehicle system. Specifically, the pedal assembly includes a multi-pole cylindrical magnet that rotates with pivotal pedal movement to generate a linear output signal varying with pedal deflection.

BACKGROUND OF THE INVENTION

Pedal assemblies are used to control movement of a vehicle. Typically pedal assemblies include mechanical connections to the respective vehicle system that the pedal controls. For example, a mechanical connection for an accelerator pedal usually includes a bracket and cable-connect to an engine throttle. The rotary movement of the pedal is transferred to the engine throttle via the cable. The cable controls the position of the engine throttle based on the position of the pedal. Similar mechanical connections are used for brake and clutch pedals.

As vehicles incorporate more electrically control vehicle systems, attempts have been made to provide an electrical link between the pedal and the vehicle system to be controlled. Mechanical connections are often bulky and difficult to package within the limited space available in the vehicle. The components in the mechanical linkages are also subject to wear and can bind or stick causing the vehicle system to become inoperable. The electrical link eliminates the need for mechanical linkage parts and thus, reduces cost and increases packaging space for other vehicle components.

Some pedals incorporating electric control utilize contact sensors such as potentiometers to generate the control signal as the pedal pivots between various operational positions. One disadvantage with the use of contact sensors is that they tend to wear over time, which can affect the accuracy of the control signal.

Sometimes non-contact sensors such as Hall effect sensors are used to generate the control signal. An example of a pedal incorporating a non-contact type sensor for electric control is shown in U.S. Pat. No. 5,439,275. The pedal assembly includes a Hall Effect sensor used in combination with magnets mounted within a plunger to generate an output signal that varies according to pedal position. As the pedal is pivoted, the plunger moves in a linear direction with respect to the sensor resulting in a varying magnetic field. In such a configuration it is difficult to convert rotational pedal input movement into an accurate linear output from the sensor, which can be used to control the vehicle system.

Thus, it would be desirable to have an improved pedal assembly with a non-contact sensor that can use rotational pedal input to produce a linear output that corresponds to pedal deflection so that an accurate control signal can be used to control the corresponding vehicle system.

SUMMARY OF THE INVENTION AND ADVANTAGES

A pedal assembly for a motor vehicle is used to generate a control signal for a vehicle system. The pedal assembly includes a support mounted to a vehicle body structure and a pedal arm with an upper end pivotally mounted to the support for movement relative to the body structure and a lower end for supporting a pedal pad. The pedal arm is movable between a plurality of operational positions as a force is applied to the pedal pad. A magnet is mounted to the pedal arm for pivotal movement with the pedal arm. A non-contact sensor assembly is mounted adjacent to the magnet such that the sensor remains fixed relative to the pedal arm at all operational positions. The sensor generates an electric control signal for controlling the vehicle system as the pedal arm is moved between the operational positions. The signal varies in magnitude by the extent of angular rotation of the magnet relative to the sensor. Thus, the sensor converts rotational movement of the magnet to a linear output control signal that is used to control the vehicle system.

The sensor measures a varying magnetic field generated by the magnet as the pedal arm pivots between operational positions and generates a linear output voltage proportional pedal deflection. In the preferred embodiment, the magnet is a permanent magnet including multiple poles alternating between positive and negative orientations. The permanent magnet is preferably cylindrical in shape with each of the poles having a predetermined width with the poles alternating between positive and negative orientations about the circumference of the magnet.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
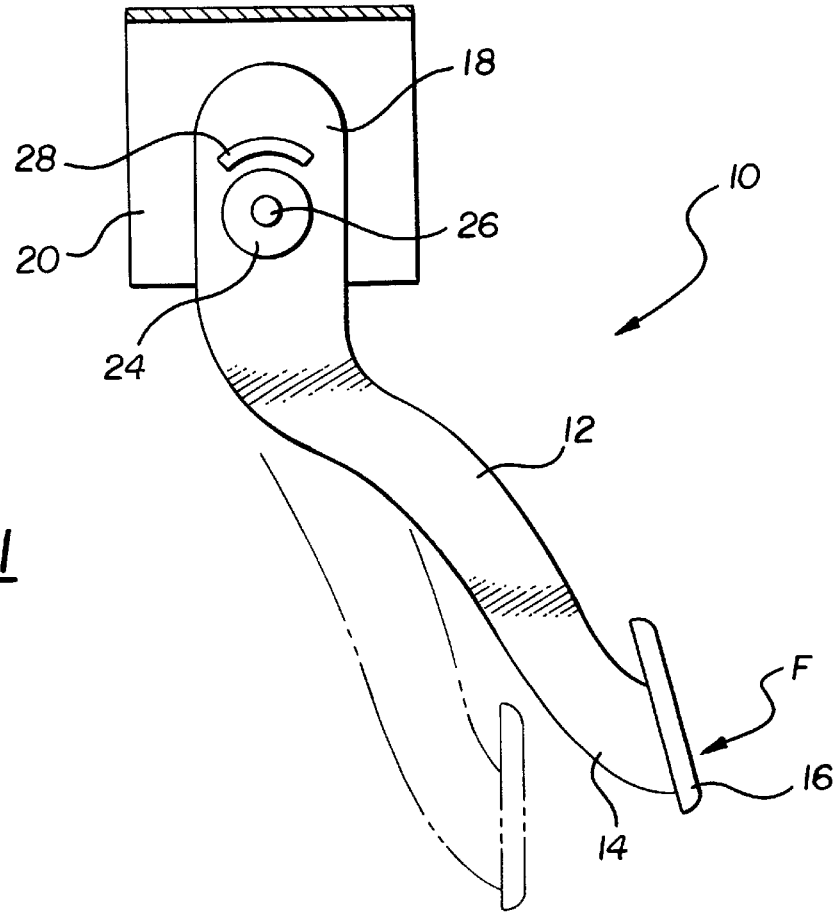
FIG. 1 is a side view of the subject pedal assembly showing the pedal in a rest position in solid lines and an applied position in dashed lines.

Referring to the Figures, wherein like numerals indicate like or corresponding parts throughout the several views, a pedal assembly is shown generally at 10 in FIG. 1. The pedal assembly 10 includes a pedal arm 12 with a lower end 14 operatively connected to a pedal pad 16 and an upper end 18 pivotally mounted with a support housing or bracket 20. The housing or bracket 20 is connected to a vehicle body structure 22, such as a dash or frame member.

The pedal arm 12 is movable between a plurality of operational positions as a force F is applied to the pedal pad 16. A magnet 24 is mounted to the pedal arm 12 for pivotal movement therewith. The magnet 24 is supported on a pivot shaft 26 that is mounted to the bracket 20. A non-contact sensor assembly 28 is mounted adjacent to the magnet 24 such that the sensor 28 remains fixed relative to the pedal arm 12 at all operational positions. preferably, the non-contact sensor 28 is a Hall Effect sensor whose operation is well known in the art, however, other non-contact sensors could also be used.

Figure 2:
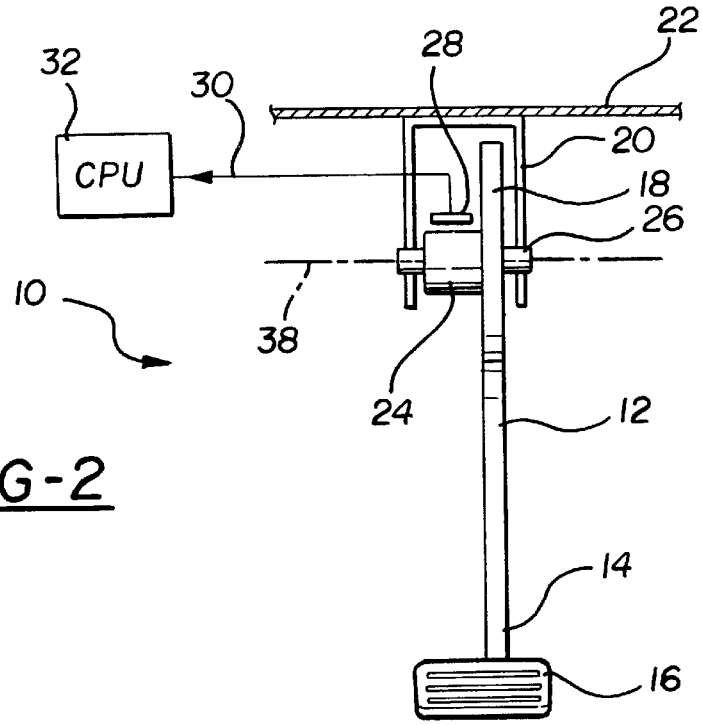
FIG. 2 is a front view of the pedal assembly shown in FIG. 1.

As shown in FIG. 2, the sensor 28 generates an electric control signal 30 for controlling a vehicle system as the pedal arm 12 is moved between the operational positions. The control signal 30 varies in magnitude by the extent of angular rotation of the magnet 24 relative to the sensor 28. The control signal 30 is transmitted to a central processing unit 32, such as a computer or some other similar type processing unit known in the art. The central processing unit 32 receives the signal and controls the position of a vehicle system component 44, such as an engine throttle, based on the signal 30.

Thus, the pedal assembly 10 generates the electric control signal 30 to control a vehicle system function such as a throttle position. The control signal 30 could also be used to control braking or a clutch mechanism. The electric control signal 30 varies in magnitude as the force F is applied to the pedal pad 16 to move the pedal arm from a rest position to an applied position.

Figure 3:
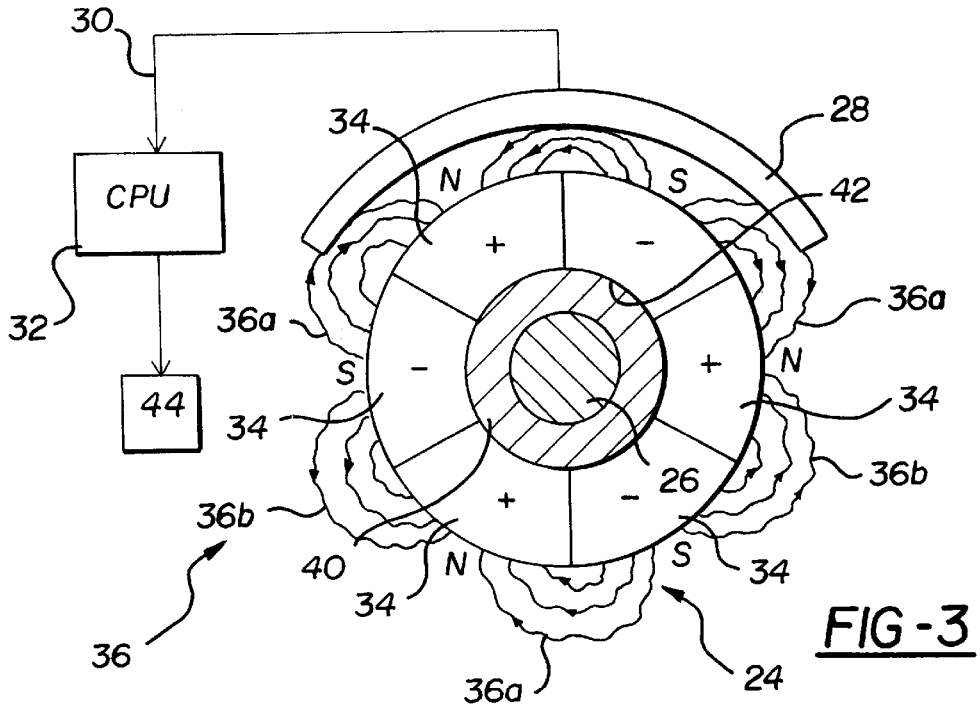
FIG. 3 is a schematic view of the control and sensing system used to generate a control signal.

Preferably, the magnet 24 is a permanent magnet including multiple poles 34 alternating between positive (+) and negative (−) orientations, i.e., north and south orientations as shown in FIG. 3. The permanent magnet 24 is cylindrical in shape with each of the poles 34 having a predetermined width with the poles 34 alternating between positive (+) and negative (−) orientations about the circumference of the magnet 24. The width of the poles controls the linearity of the output control signal 30.

Figure 4:
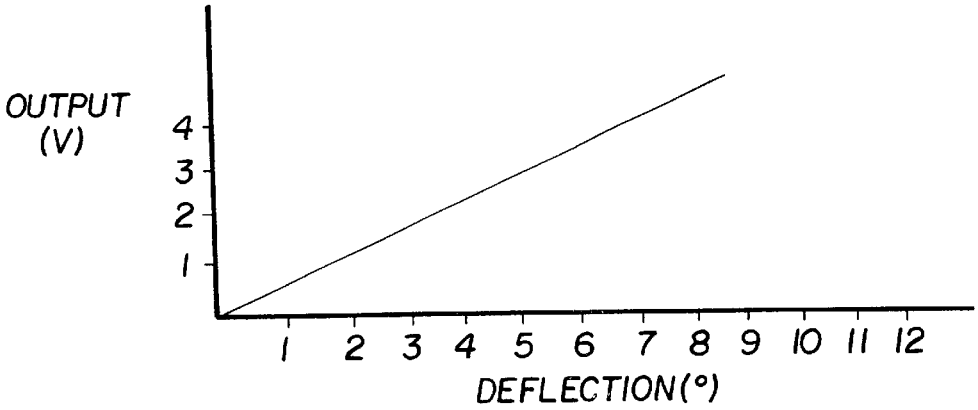
FIG. 4 is a graph showing output voltage v. pedal deflection.

Variable pole width manipulation is used to increase linearity between the poles 34 on a multi-pole magnet 24 for sensing a linear magnetic field, generally indicated at 36, during angular rotation of the field 36 as the pedal arm 12 pivots. The linear relationship between the output signal 30 and pedal deflection is shown in FIG. 4. The output signal in volts (V) increases linearly with increased pedal deflection, shown in degrees (°). The alternating of poles 34 creates magnetic fields 36 having differing field directions. One set of fields 36*a* has a clockwise field orientation while another set of fields 36*b* has a counterclockwise field orientation. the preferred embodiment, there are three (3) negative (−) poles 34 alternated with three (3) positive (+) poles 34. The diameter of the magnet 24 and the dimensions of the pole widths can be varied to achieve the desired magnetic field strength and orientations.

As discussed above, the pedal arm 12 is supported on a non-rotatable or fixed pivot shaft or pin 26 to define an axis of rotation 38 as the pedal arm 12 is pivoted between operational positions. The pedal arm 12 includes a transversely extending shaft portion 40 for supporting the magnet 24. The shaft portion 40 can be integrally formed with the pedal arm 12 as one piece or can be separately attached via fasteners, welding or other joining methods know in the art. The pivot shaft 26 and the transversely extending shaft 40 are concentric.

The magnet 24 includes a central bore 42 that is concentric with the transversely extending shaft 40. The magnet 24 is installed on the shaft 40 by sliding the bore 42 over the shaft in a tight fit such that the magnet 24 rotates with the shaft 40. The transversely extending shaft 40 rotates with respect to the pivot shaft 26 about the axis of rotation 38 as the pedal arm 12 is moved between operational positions. As the magnet 24 rotates the sensor 28 measures the varying magnetic field 36 generated by the magnet 24 as the pedal arm 12 pivots between operational positions and generates a linear output voltage proportional to pedal deflection.

Figure 5:
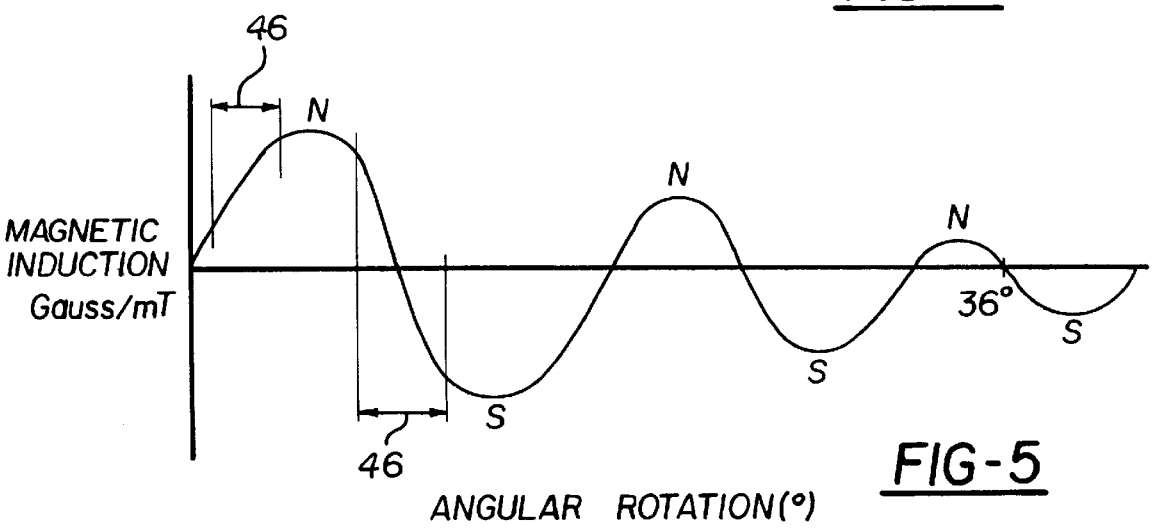
FIG. 5 is a graph showing magnetic induction v. angular rotation.

The non-contact sensor 28 is mounted adjacent to the magnet 24 such that the sensor 28 remains fixed relative to the pedal arm 12 and rotating magnet 24 at all operational positions. Thus, one of the advantages of this configuration is that rotational movement of the magnet 24 is converted to a linear output control signal via the sensor 28 to control the vehicle system component 44. This linear relationship is indicated at 46 in FIG. 5 showing a graph of magnetic induction in (Gauss/mT) v. angular rotation of the pedal arm 12 in degrees (°).

Although the inventive pedal assembly 10 has been described in detail for use in controlling the throttle of the associated vehicle, the inventive pedal assembly 10 may be used to electrically control a wide variety of vehicle functions or accessories.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A pedal assembly adapted to be mounted on a body structure of a motor vehicle and operative to generate a control signal for vehicle system, said assembly comprising:

a support adapted to be mounted to the body structure;

a pedal arm having an upper end pivotally mounted to said support for movement relative to the body structure and a lower end for supporting a pedal pad, said pedal arm being movable between a plurality of operational positions as a force is applied to said pedal pad;

a magnet including multiple poles and cylindrical in shape with each of said poles having a predetermined width with said poles alternating between positive and negative orientations about the circumference of said magnet and a non-contact sensor mounted adjacent to said magnet such that said sensor remains fixed relative to said pedal arm at all operational positions wherein said sensor generates an electric control signal for controlling a vehicle system as said pedal arm is moved between said operational positions, said signal varying in magnitude by the extent of angular rotation of said magnet relative to said sensor, a non-rotatable pivot shaft fixed to said support and defining an axis of rotation for said pedal arm to pivot between operational positions, a transversely extending shaft for supporting said magnet and rotatably supported on said pivot shaft, said transversely extending shaft being concentric by being disposed about said pivot shaft, whereby said transversely extending shaft rotates about said pivot shaft about said axis of rotation as said pedal arm is moved between operational positions.

2. An assembly according to claim 1 wherein said multiple poles are comprised of three negative poles alternated with three positive poles.

3. An assembly according to claim 1 wherein said sensor measures a varying magnetic field generated by said magnet as said pedal arm pivots between operational positions and generates a linear output voltage proportional to pedal deflection.

* * * * *